US006758726B2

(12) United States Patent
Renteln

(10) Patent No.: US 6,758,726 B2
(45) Date of Patent: Jul. 6, 2004

(54) PARTIAL-MEMBRANE CARRIER HEAD

(75) Inventor: Peter Renteln, San Ramon, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/186,888

(22) Filed: Jun. 28, 2002

(65) Prior Publication Data

US 2004/0002291 A1 Jan. 1, 2004

(51) Int. Cl.[7] ..... B24B 1/00; B24B 7/00

(52) U.S. Cl. ..... 451/41; 451/59; 451/63; 451/289; 451/388; 451/398

(58) Field of Search ..... 451/36, 41, 59, 451/63, 285, 286, 287, 288, 289, 290, 385, 388, 397, 398

(56) References Cited

U.S. PATENT DOCUMENTS

2002/0177394 A1 * 11/2002 Hollatz et al. ..... 451/388
2003/0045205 A1 * 3/2003 Herb et al. ..... 451/5
2003/0114087 A1 * 6/2003 Duboust et al. ..... 451/41

* cited by examiner

*Primary Examiner*—Timothy V. Eley
(74) *Attorney, Agent, or Firm*—Martine & Pennilla, LLP

(57) ABSTRACT

An invention is provided for a carrier head that includes a metal plate having an opening formed in a central location. The metal plate has a wafer side, which faces the backside of a wafer during a CMP operation, and a non-wafer side. Positioned above the non-wafer side of the metal plate, and located above the opening in the metal plate, is a bladder or membrane. To facilitate uniformity during polishing, an inflating pressure is applied to the bladder, or membrane, that is substantially equivalent to a polishing pressure utilized during the CMP operation. To facilitate transporting the wafer, a vacuum can be applied to the opening in the metal plate to adhere the wafer to the carrier head. Further, to release the wafer from the carrier head, the bladder, or membrane, can be inflated such that it protrudes through the opening in the metal plate.

20 Claims, 9 Drawing Sheets

PARTIAL-MEMBRANE CARRIER HEAD

BACKGROUND OF THE INVENTION

1. Field of the Invention

This invention relates generally to chemical mechanical planarization, and more particularly to partial-membrane carrier heads for use in a chemical mechanical planarization process.

2. Description of the Related Art

In the fabrication of semiconductor devices, planarization operations are often performed, which can include polishing, buffing, and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide.

As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal planarization operations are performed to remove excess metallization. Further applications include planarization of dielectric films deposited prior to the metallization process, such as dielectrics used for shallow trench isolation or for poly-metal insulation. One method for achieving semiconductor wafer planarization is the chemical mechanical planarization (CMP) process.

In general, the CMP process involves holding and rubbing a typically rotating wafer against a moving polishing pad under a controlled pressure and relative speed. CMP systems typically implement orbital, belt, or brush stations in which pads or brushes are used to scrub, buff, and polish one or both sides of a wafer. Slurry is used to facilitate and enhance the CMP operation. Slurry is most usually introduced onto a moving preparation surface and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1A is a diagram showing a conventional table based CMP apparatus 50. The conventional table based CMP apparatus 50 includes a carrier head 52, which holds a wafer 54, and is attached to a translation arm 64. In addition, the table based CMP apparatus 50 includes a polishing pad 56 that is disposed above a polishing table 58, which is often referred to as a polishing platen.

In operation, the carrier head 52 applies downward force to the wafer 54, which contacts the polishing pad 56. Reactive force is provided by the polishing table 58, which resists the downward force applied by the carrier head 52. A polishing pad 56 is used in conjunction with slurry to polish the wafer 54. Typically, the polishing pad 56 comprises foamed polyurethane or a sheet of polyurethane having a grooved surface. The polishing pad 56 is wetted with a polishing slurry having both an abrasive and other polishing chemicals. In addition, the polishing table 58 is rotated about its central axis 60, and the carrier head 52 is rotated about its central axis 62. Further, the polishing head can be translated across the polishing pad 56 surface using the translation arm 64. In addition to the table based CMP apparatus 50 discussed above, linear belt CMP systems have been conventionally used to perform CMP.

FIG. 1B shows a side view of a conventional linear wafer polishing apparatus 100. The linear wafer polishing apparatus 100 includes a carrier head 108, which secures and holds a wafer 104 in place during processing. A polishing pad 102 forms a continuous loop around rotating drums 112, and generally moves in a direction 106 at a speed of about 400 feet per minute, however this speed may vary depending upon the specific CMP operation. As the polishing pad 102 moves, the carrier head 108 rotates and lowers the wafer 104 onto the top surface of the polishing pad 102, loading it with required polishing pressure.

A bearing platen manifold assembly 110 supports the polishing pad 102 during the polishing process. The platen manifold assembly 110 may utilize any type of bearing such as a fluid bearing or a gas bearing. The platen manifold assembly 110 is supported and held into place by a platen surround plate 116. Gas pressure from a gas source 114 is inputted through the platen manifold assembly 110 via a plurality of independently controlled of output holes that provide upward force on the polishing pad 102 to control the polishing pad profile.

An effective CMP process has a high polishing rate and generates a substrate surface which is both finished, that is, lacks small-scale roughness, and flat, meaning that the surface lacks large-scale topography. The polishing rate, finish and flatness are determined by the pad and slurry combination, the relative speed between the substrate and pad, and the force pressing the substrate against the pad.

The polishing rate depends upon the force pressing the substrate against the pad. Specifically, the greater this force, the higher the polishing rate. If the carrier head applies a non-uniform load, i.e., if the carrier head applies less force to one region of the substrate than to another, then the low pressure regions will be polished slower than the high pressure regions. Therefore, a non-uniform load may result in non-uniform polishing of the substrate.

FIG. 2 is an illustration showing a conventional carrier head 108, which includes a stainless steel plate (not shown) surrounded by a retaining ring 200 for holding a wafer in position during polishing. Covering the stainless steel plate, and positioned within the retaining ring 200, is a carrier film 202. In addition, vacuum holes 204 are positioned in the stainless steel plate and corresponding positions in the carrier film 202.

The carrier film 202 is designed to absorb pressure during wafer polishing, thus preventing hot pressure spots from occurring on the wafer surface. In the present disclosure, the term "hot pressure spots" refers to wafer surface areas wherein increased downforce pressure results in a higher removal rate for that wafer surface area. Thus, hot pressure spots can result in non-uniformity problems during CMP processing, which are generally avoided by the use of the carrier film 202.

During wafer processing, the wafer must be transported from station to station. To facilitate wafer transportation, the carrier head 108 includes vacuum holes 204 that allow the carrier head 108 to pick up and drop off the wafer. For example, after completing a polishing operation, the carrier head 108 transports the wafer from the surface of the polishing belt to the next station in the wafer fabrication process. However, the wafer often experiences "stiction" with the polishing belt. That is, the combination of the polyurethane of the polishing belt surface and the slurry often causes the wafer to adhere to the surface of the polishing belt. To break this adhesion, the carrier head 108 applies a vacuum to the back of the wafer via the vacuum holes 204, which allows the carrier head 108 to lift the wafer from the surface of the polishing belt. After transporting the wafer to the next wafer fabrication station, the carrier head 108 applies a positive airflow through the vacuum holes 204 to release the wafer from the carrier film 202 of the carrier head 108.

Unfortunately, the vacuum holes 204 of the carrier head 108 cause low removal rate areas on the surface of the wafer, which result in non-uniformity errors. FIG. 3 is a diagram showing an exemplary wafer 104 resulting from CMP operations using a conventional a carrier head. During the CMP process the carrier film on the carrier head is wet. However, when vacuum is applied through the carrier head vacuum holes, the vacuum tends to dry out the carrier film around the vacuum holes, which can make the carrier film softer in the regions of the vacuum holes. In addition, there is no direct wafer support in the regions of the vacuum holes. Thus, because of the dry carrier film and lack of wafer support in the region of the vacuum holes, the low removal rate "vacuum hole" regions 300 occur on the surface of the wafer 104. The resulting non-uniformity can have a dramatic negative effect on the devices formed on the wafer, often causing the entire wafer to be discarded. Moreover, the vacuum holes of the conventional carrier head allow the mechanics of the vacuum to take in slurry when vacuum is on. This slurry often finds its way into the internal mechanics of the tool, where it is generally detrimental.

Carrier heads have been developed that attempt to avoid low removal rate vacuum hole regions on the surface of the wafer. For example, one conventional carrier head uses an inflatable bladder essentially in place of the stainless steel plate to transfer downforce to the back of the wafer during the CMP process. However, this inflatable bladder requires a floating retaining ring that complicates the CMP process. Moreover, the floating retaining ring generally causes undesirable edge effects, wherein the removal rate at the edge of the wafer is very high with respect to the remainder of the wafer.

In view of the foregoing, there is a need for a carrier head that avoids low removal rate vacuum hole regions on the surface of the wafer. The carrier head should be usable on various types of CMP systems, and should not require undue experimentation and engineering to implement. In particular, the carrier head should not require overly complex systems, such as a floating retaining ring, and should provide a uniform wafer surface during CMP.

SUMMARY OF THE INVENTION

Broadly speaking, the present invention fills these needs by providing a partial-membrane carrier head that avoids low removal rate vacuum hole regions in the surface of a wafer. Embodiments of the present invention replace the plurality of vacuum holes on the carrier head with a larger centralized vacuum hole. During polishing, a bladder or membrane is inflated in the region of the centralized vacuum hole such that pressure in the region of vacuum hole is essentially equal to the polishing pressure.

For example, in one embodiment, the carrier head includes a metal plate having an opening formed in a central location. The metal plate has a wafer side, which faces the backside of a wafer during a CMP operation, and a non-wafer side. Positioned above the non-wafer side of the metal plate, and located above the opening in the metal plate, is a bladder. To facilitate uniformity during polishing, an inflating pressure is applied to the bladder substantially equivalent to a polishing pressure utilized during the CMP operation. The carrier head can further comprise a carrier film, which is positioned on the wafer side of the metal plate. The carrier film is disposed between the metal plate and the backside of the wafer during a CMP operation. In this aspect, the metal plate and the bladder can provide a substantially uniform force to the carrier film. To facilitate transporting the wafer, a vacuum can be applied to the opening in the metal plate to adhere the wafer to the carrier head. The bladder can be deflated when the vacuum is applied to the opening in the metal plate. Further, to release the wafer from the carrier head the bladder can be inflated such that it protrudes through the opening in the metal plate.

A further carrier head for use in a CMP process is disclosed in an additional embodiment of the present invention. The carrier head includes a metal plate having an opening formed in a central location. As above, the metal plate has a wafer side, which faces the backside of a wafer during a CMP operation, and a non-wafer side. Positioned above the non-wafer side of the metal plate, and located above the opening in the metal plate, is a membrane. To facilitate uniformity during polishing, a pressure is applied to the membrane that is substantially equivalent to a polishing pressure utilized during the CMP operation. As above, the carrier head can further comprise a carrier film, which is positioned on the wafer side of the metal plate. The carrier film is disposed between the metal plate and the backside of the wafer during a CMP operation. In this aspect, the metal plate and the membrane can provide a substantially uniform force to the carrier film. To facilitate transporting the wafer, a vacuum can be applied to the opening in the metal plate to adhere the wafer to the carrier head. To release the wafer from the carrier head a releasing pressure can be applied to the membrane, such that the releasing pressure causes the membrane to protrude through the opening in the metal plate.

A method for polishing a wafer during a CMP process is disclosed in yet a further embodiment of the present invention. The method includes positioning a wafer on a carrier head that includes a metal plate having an opening formed in a central location, and a bladder positioned above the opening in the metal plate. The bladder is situated on a side of the metal plate opposite a side on which the wafer is positioned. The wafer is applied to a polishing surface with a particular polishing pressure using the carrier head. In addition, the bladder is inflated to a pressure that is substantially equivalent to the polishing pressure, and the surface of the wafer is polished. Similar to above, a carrier film can be positioned between the metal plate and a backside of the wafer, such that the metal plate and the bladder provide a substantially uniform force to the carrier film. In addition, a vacuum can be applied to the opening in the metal plate to adhere the wafer to the carrier head to facilitate transporting the wafer. To release the wafer from the carrier head, the bladder can be inflated such that the bladder protrudes through the opening in the metal plate to release the wafer from the carrier head.

Embodiments of the present invention can be advantageously utilized to polish wafers without generating low removal rate vacuum hole regions of the wafer surface. In particular, because the plurality of vacuum holes is removed, low removal rate vacuum hole regions are not generated on the wafer surface in those areas. Further, the bladder and membrane provide pressure in the region of the centrally located vacuum hole during polishing. Thus, a low removal rate vacuum hole region is prevented from occurring in the wafer surface in the region of the centrally located vacuum hole. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a partial-membrane carrier head that avoids low removal rate vacuum hole regions in the surface of a wafer. Generally, the partial-membrane carrier head of the embodiments of the present invention replaces the plurality of vacuum holes on the carrier head with a larger centralized vacuum hole. During polishing, a bladder or membrane is inflated in the region of the centralized vacuum hole such that pressure in the region of vacuum hole is essentially equal to the polishing pressure, which is the downforce being transferred to the wafer via the carrier head. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1A:
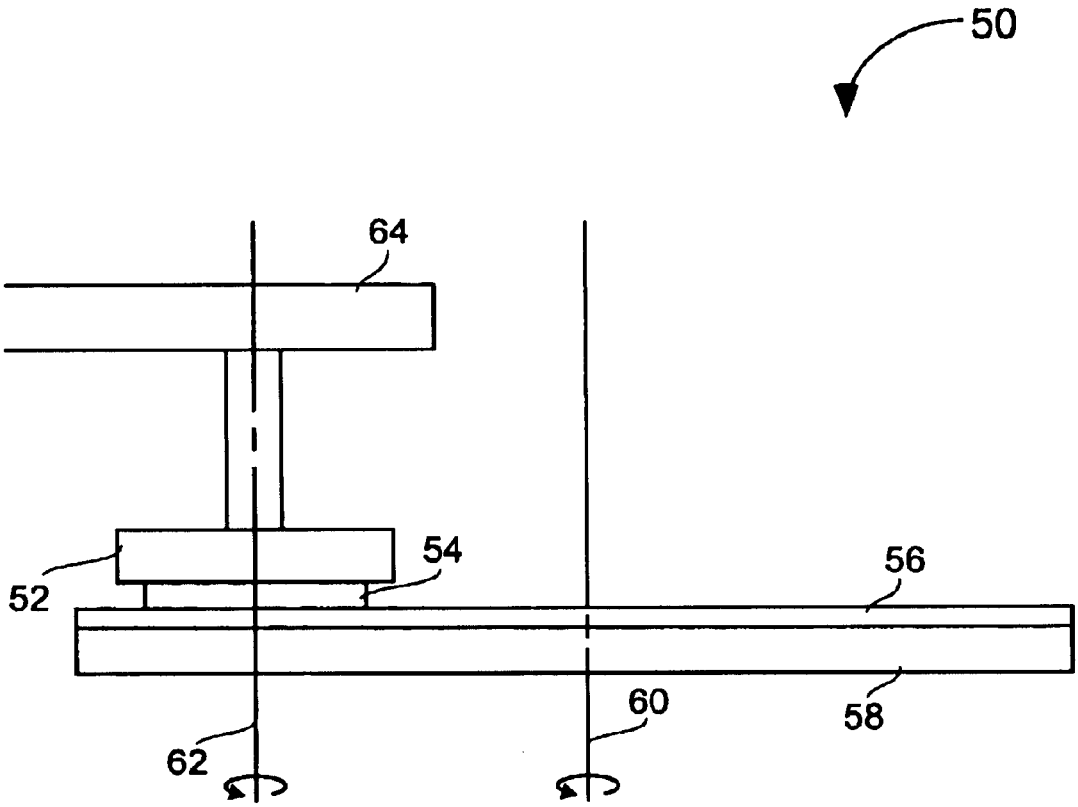
FIG. 1A (Prior Art)
FIG. 1A is a diagram showing a conventional table based CMP apparatus.
Figure 1B:
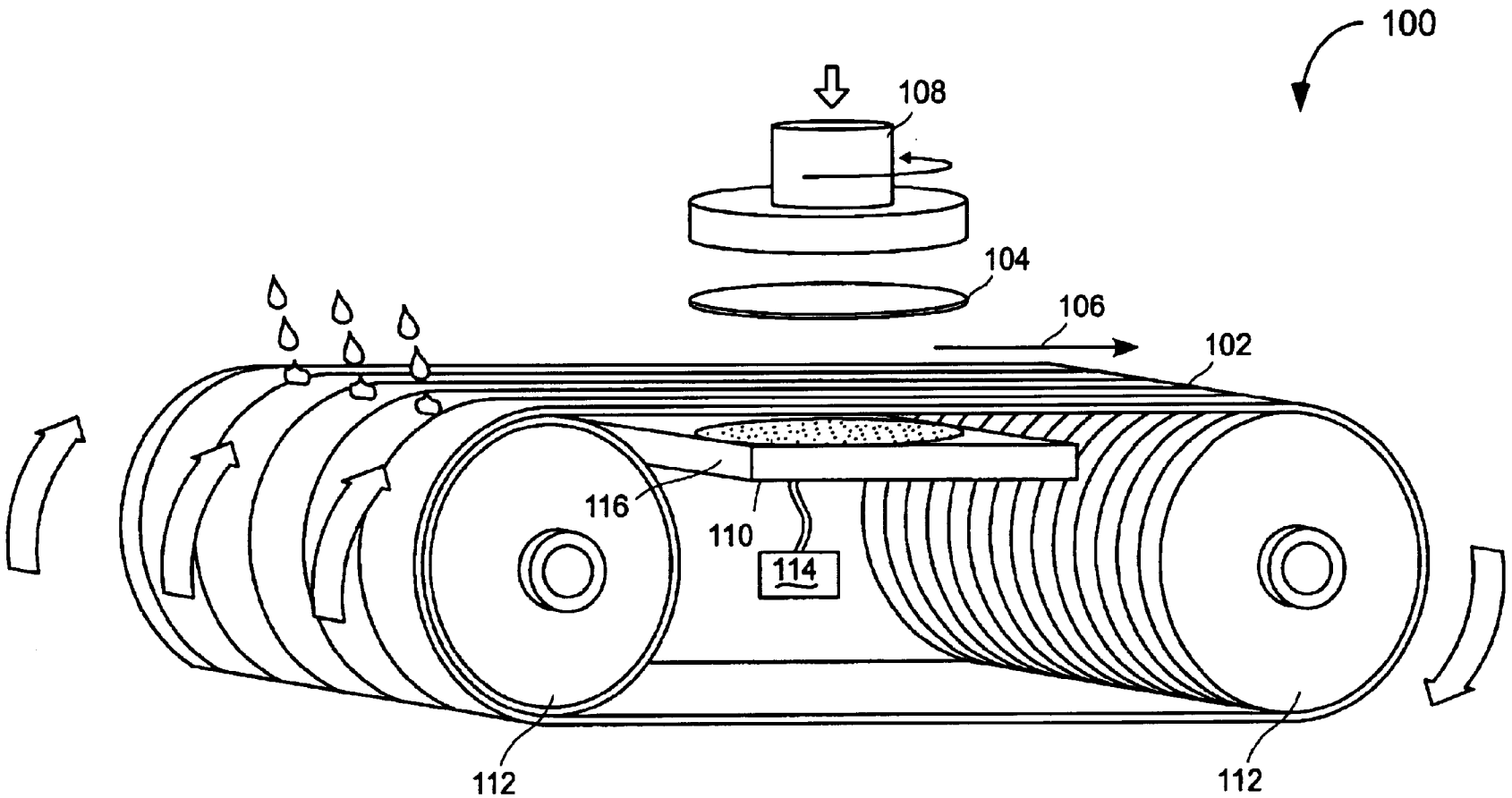
FIG. 1B shows a side view of a conventional linear wafer polishing apparatus.
Figure 2:
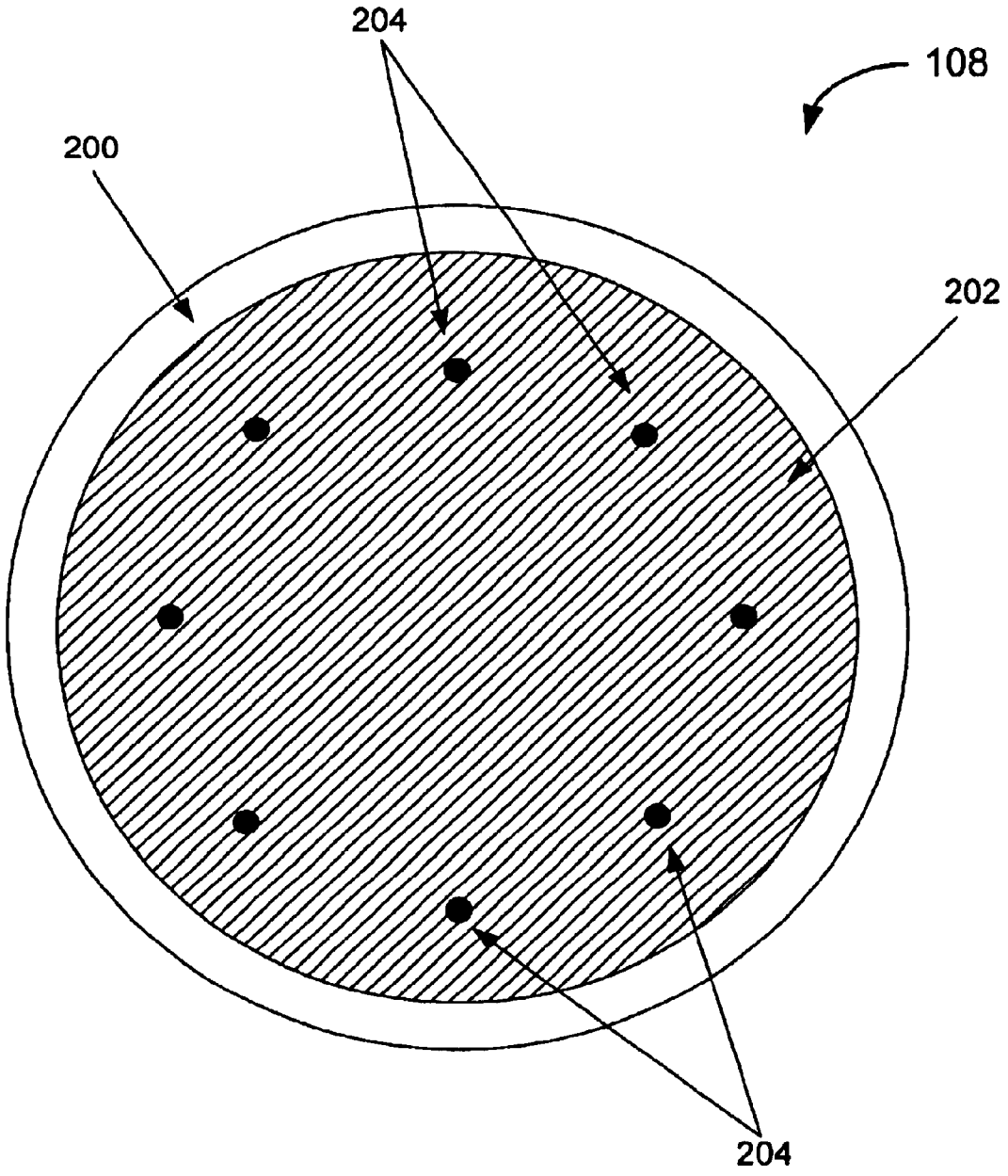
FIG. 2 (Prior Art)
FIG. 2 is an illustration showing a conventional carrier head.
Figure 3:
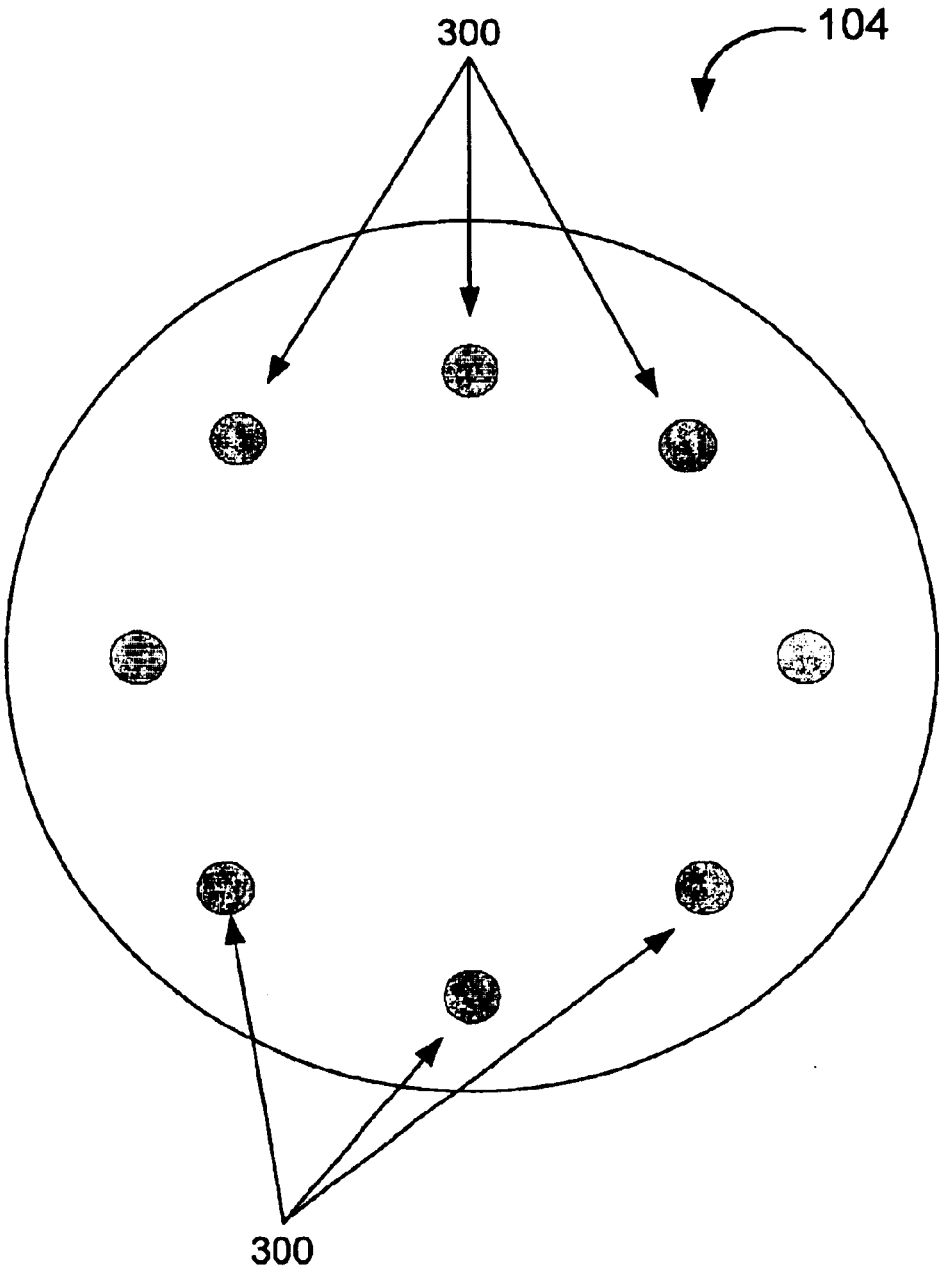
FIG. 3 (Prior Art)
FIG. 3 is a diagram showing an exemplary wafer resulting from CMP operations using a conventional a carrier head.
Figure 4:
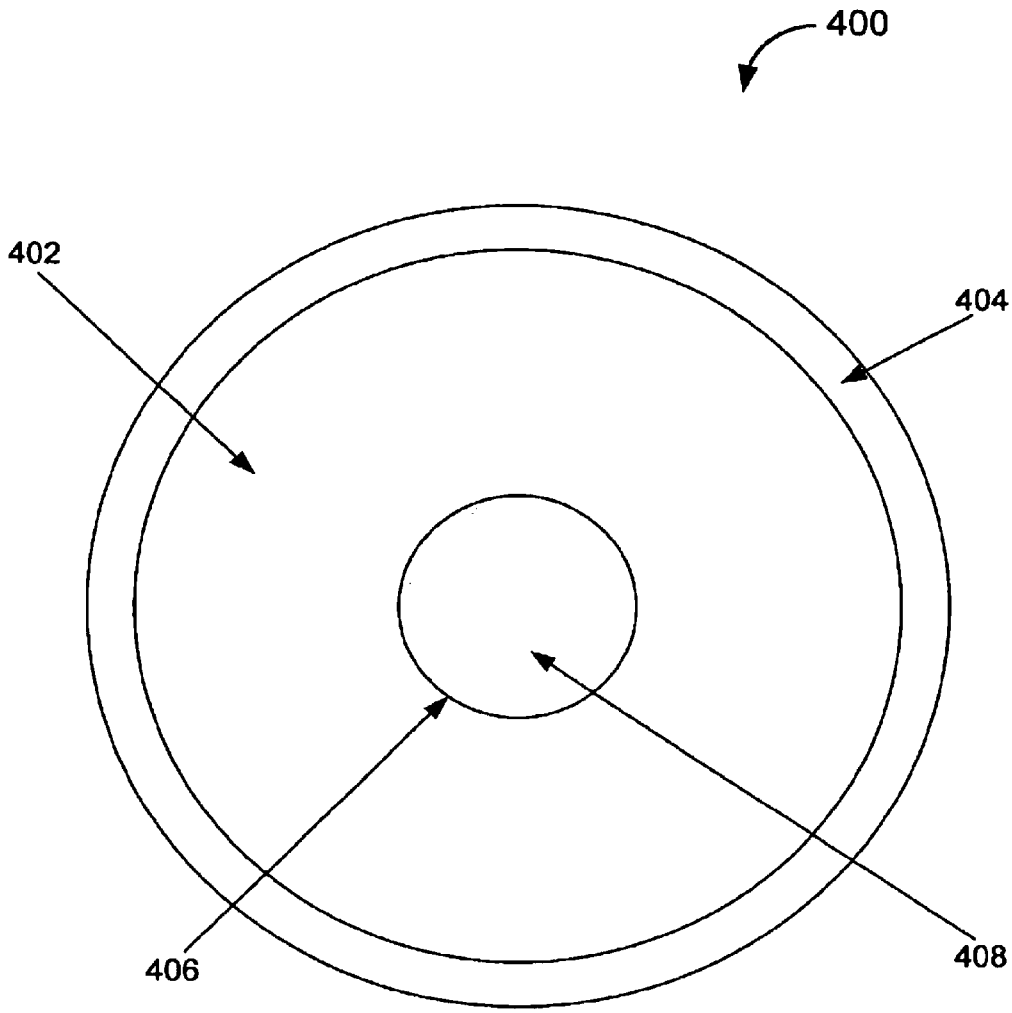
FIG. 4 is diagram showing a bottom view of a partial-membrane carrier head, in accordance with an embodiment of the present invention.

FIG. 4 is diagram showing a bottom view of a partial-membrane carrier head 400, in accordance with an embodiment of the present invention. The carrier head 400 includes a stainless steel plate 402 surrounded by a retaining ring 404, which holds a wafer in position during polishing. During actual polishing a carrier film (not shown) is positioned over the wafer side of the stainless steel plate, in particular, between the stainless steel plate 402 and the backside of the wafer. The carrier film is designed to absorb pressure during wafer polishing, thus preventing hot pressure spots from occurring on the wafer surface. As mentioned above, hot pressure spots can result in non-uniformity problems during CMP processing, which are generally avoided by the use of the carrier film.

An opening 406 is formed in a central location of the stainless steel plate, above which is positioned a bladder 408. Embodiments of the present invention replace the plurality of vacuum holes on the carrier head with a larger centralized vacuum hole 406. During polishing, the bladder 408 is inflated in the region of the centralized vacuum hole 406 such that pressure in the region of vacuum hole is essentially equal to the polishing pressure, which is the downforce being transferred to the wafer via the carrier head. In this manner, the metal plate and the bladder provide a substantially uniform force to the carrier film. Typically, for a 300 millimeter (mm) wafer, the vacuum hole 406 can have a diameter in the range of about 1 inch to 3 inches.

Although the carrier head 400 has been described in terms of using a stainless steel plate, it should be noted that any type of material capable of transferring force to a wafer can be used. For example, other metals, plastics, or any other material usable in carrier heads in CMP processes can be utilized in place of the stainless steel. Similarly, the bladder 408 can comprise any type of material capable of flexing and exerting a pressure on the backside of a wafer. For example, the bladder can comprise a rubber, polyurethane, or any other material capable of being flexed so as to exert pressure through the opening 406 in the stainless steel plate 402.

In one embodiment, the retaining ring 404 is a fixed retaining ring, which does not move during the CMP process. However, embodiments of the present invention can be implemented using any type of retaining ring capable of holding a wafer in position during a CMP operation. For example, the retaining ring can be active to adjust the shape of the polishing belt during wafer polishing.

Figure 5:
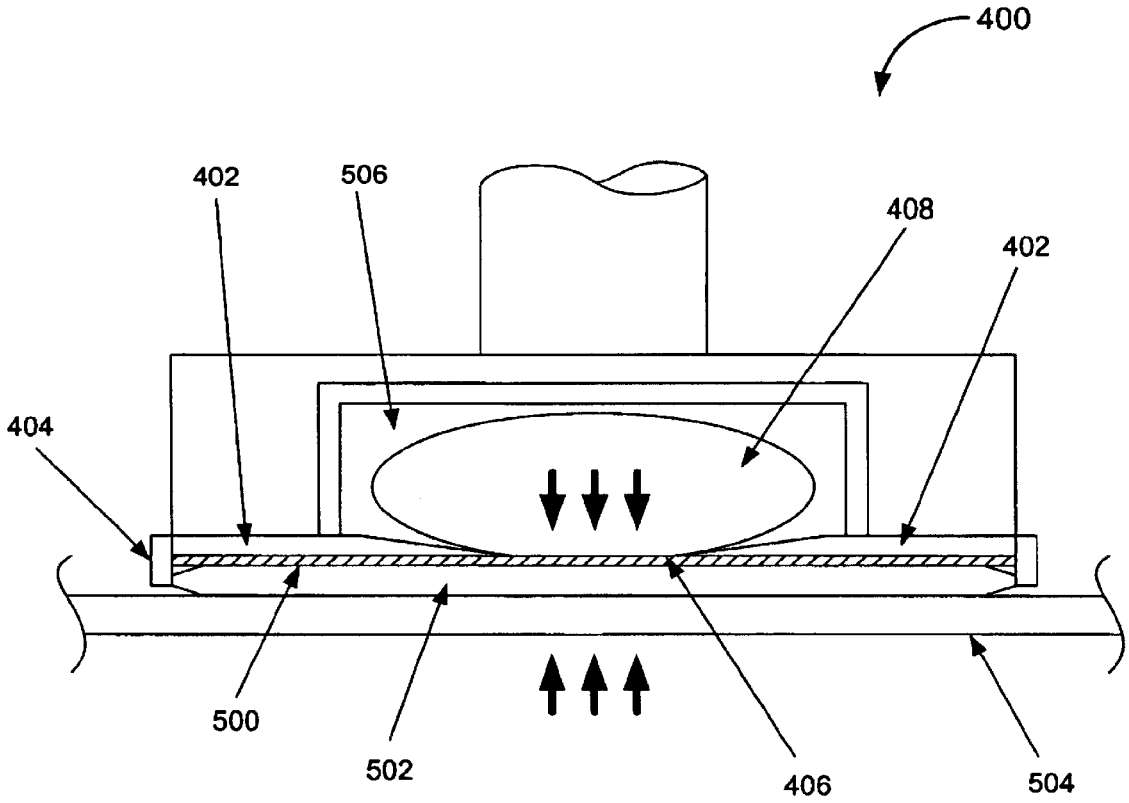
FIG. 5 is a side view of a partial-membrane carrier head, in accordance with an embodiment of the present invention.

FIG. 5 is a side view of a partial-membrane carrier head 400, in accordance with an embodiment of the present invention. As above, the carrier head 400 includes a stainless steel plate 402 surrounded by a retaining ring 404, which holds a wafer 502 in position during polishing. In addition, a carrier film 500 is positioned on the wafer side of the stainless steel plate 402. In particular, the carrier film 500 is positioned between the stainless steel plate 402 and the backside of the wafer 502.

An opening 406 is formed in a central location of the stainless steel plate 402, above which is positioned a bladder 408. In one embodiment, the bladder 408 is disposed within a vacuum chamber 506, which can provide a full or dynamic vacuum environment during transportation of the wafer 502, as will be described in greater detail subsequently. As mentioned previously, embodiments of the present invention replace the plurality of vacuum holes on the carrier head with a larger centralized vacuum hole 406. During polishing, the bladder 408 is inflated in the region of the centralized vacuum hole 406 such that pressure in the region of vacuum hole is essentially equal to the polishing pressure.

More specifically, during wafer polishing, the carrier head 400 applies the wafer 502 to the surface of a polishing belt 504. Although the present disclosure will be described in terms of a linear CMP system, it should be noted that embodiments of the present invention can also be utilized in a table based CMP system. To provide a uniform downforce on the backside of the wafer 502, the bladder 408 is inflated to substantially the same pressure as the polishing pressure used during the CMP process. In this manner, the force transferred to the wafer 502 through the carrier film 500 is essentially uniform across the surface of the stainless steel plate 402, including in the region of the vacuum hole 406 because of the pressure provided by the bladder 408.

Figure 6:
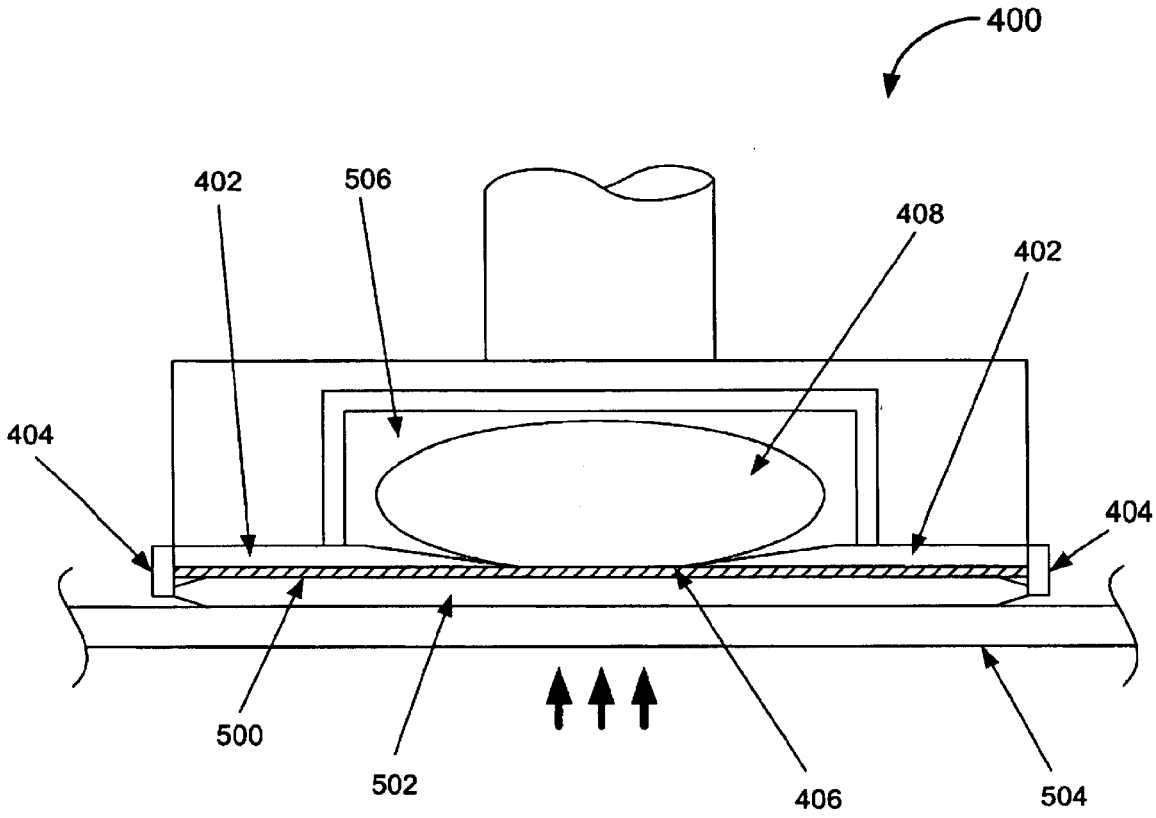
FIG. 6 is a side view of a partial-membrane carrier head during wafer transportation, in accordance with an embodiment of the present invention.

In addition to promoting uniformity across the surface of the wafer 502 during a CMP process, embodiments of the present invention further facilitate transportation of the wafer 500. FIG. 6 is a side view of a partial-membrane carrier head 400 during wafer transportation, in accordance with an embodiment of the present invention. As above, the carrier head 400 includes a stainless steel plate 402 surrounded by a retaining ring 404, which holds a wafer 502 in position during polishing. Also, a carrier film 500 is positioned on the wafer side of the stainless steel plate 402, between the stainless steel plate 402 and the backside of the wafer 502.

The centrally located vacuum hole 406 allows the carrier head 400 to pick up and drop off the wafer 502. As mentioned previously, after completing a polishing operation the carrier head 400 generally transports the wafer 502 from the surface of the polishing belt 504 to the next station in the wafer fabrication process. However, the wafer often experiences "stiction" with the polishing belt 504. That is, the combination of the polyurethane of the polishing belt surface and the slurry often causes the wafer 502 to adhere to the surface of the polishing belt 504. To break this adhesion, the carrier head 400 applies a vacuum to the back of the wafer via the centrally located vacuum hole 406, which allows the carrier head 400 to lift the wafer 502 from the surface of the polishing belt 504.

Specifically, when lifting the wafer 502, the bladder 408 is deflated and a vacuum is generated within the vacuum chamber 506. The bladder 408 can be fully deflated or partially deflated depending on the needs of the system developer and system operator. In general, the bladder 408 should be deflated so as to allow the vacuum of the vacuum chamber 506 to transfer to the carrier film 500. Because of the porous nature of the carrier film 500, the vacuum transfers through the vacuum hole 406 and the carrier film 500 to the backside of the wafer 502. In this manner, the adhesion of the wafer 502 to the carrier head 400 resulting from the vacuum overcomes the stiction between the wafer 502 and the polishing belt 504, thus allowing the carrier head 400 to lift the wafer 502.

Generally, the vacuum can be allowed to dissipate once the wafer 502 is removed from the polishing surface 504 because the wafer 502 will typically adhere to the wet carrier film 500 during transportation. Hence, the vacuum chamber 506 can be implemented such that it produces only a dynamic vacuum, which dissipates after a particular time period. It should be noted that the vacuum and carrier film 500 combination can be utilized to lift the wafer 502 from any surface in addition to lifting a wafer 502 from the surface of a polishing belt 504.

After transporting the wafer 502 to its destination, the bladder 408 is inflated such that the bladder 408 protrudes through the vacuum hole 406. The protruding bladder 408 creates a bulge in the carrier film 500, which releases the wafer 502 from the carrier head 400. It should be noted that other embodiments of the present invention can release the wafer 502 from the carrier head 400 by applying a positive airflow through the vacuum hole 406.

Using the carrier head 400 described above, embodiments of the present invention can be advantageously utilized to polish wafers without generating low removal rate vacuum hole regions of the wafer surface. In particular, because the plurality of vacuum holes is removed, low removal rate vacuum hole regions are not generated on the wafer surface in those areas. Further, the bladder 408 provides pressure in the region of the centrally located vacuum hole 406 during polishing. Thus a low removal rate vacuum hole region is prevented from occurring in the wafer surface in the region of the centrally located vacuum hole 406. In addition to utilizing a bladder 408 to provide pressure to the vacuum hole 406 during polishing, embodiments of the present invention can utilize a membrane.

Figure 7:
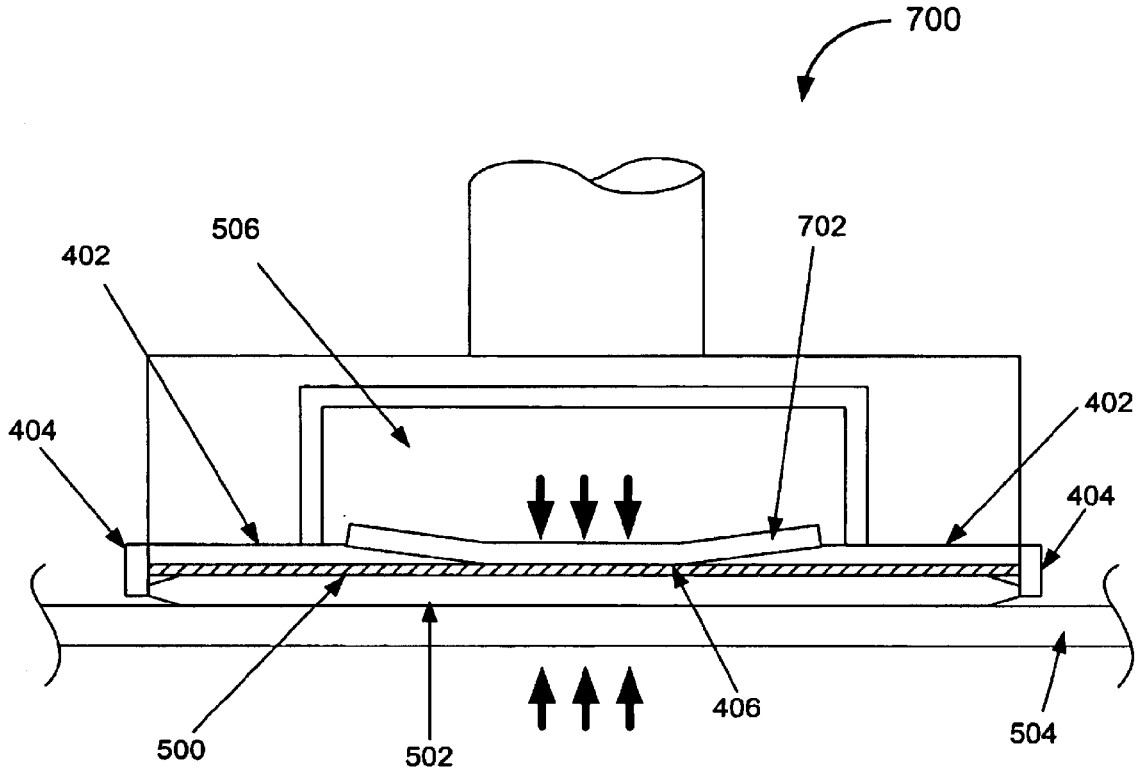
FIG. 7 is a side view of a partial-membrane carrier head utilizing a membrane, in accordance with an embodiment of the present invention.

FIG. 7 is a side view of a partial-membrane carrier head 700 utilizing a membrane, in accordance with an embodiment of the present invention. The carrier head 700 includes a stainless steel plate 402 surrounded by a retaining ring 404, which holds a wafer 502 in position during polishing. In addition, a carrier film 500 is positioned on the wafer side of the stainless steel plate 402. In particular, the carrier film 500 is positioned between the stainless steel plate 402 and the backside of the wafer 502.

As above, an opening 406 is formed in a central location of the stainless steel plate 402, above which is positioned a membrane 702. Similar to FIG. 6, the membrane 702 of FIG. 7 is disposed within a vacuum chamber 506, which can provide a full or dynamic vacuum environment during transportation of the wafer 502. As mentioned previously, embodiments of the present invention replace the plurality of vacuum holes on the carrier head with a larger centralized vacuum hole 406. During polishing, pressure is applied to the membrane 702 in the region of the centralized vacuum hole 406 such that the pressure in the region of vacuum hole is essentially equal to the polishing pressure.

As discussed previously, the carrier head 400 applies the wafer 502 to the surface of a polishing belt 504 during wafer polishing. To provide a uniform downforce on the backside of the wafer 502, pressure substantially equivalent to the polishing pressure used during the CMP process is applied to the membrane 702. In this manner, the force transferred to the wafer 502 through the carrier film 500 is essentially uniform across the surface of the stainless steel plate 402, including in the region of the vacuum hole 406 because of the pressure provided by the membrane 702.

Figure 8:
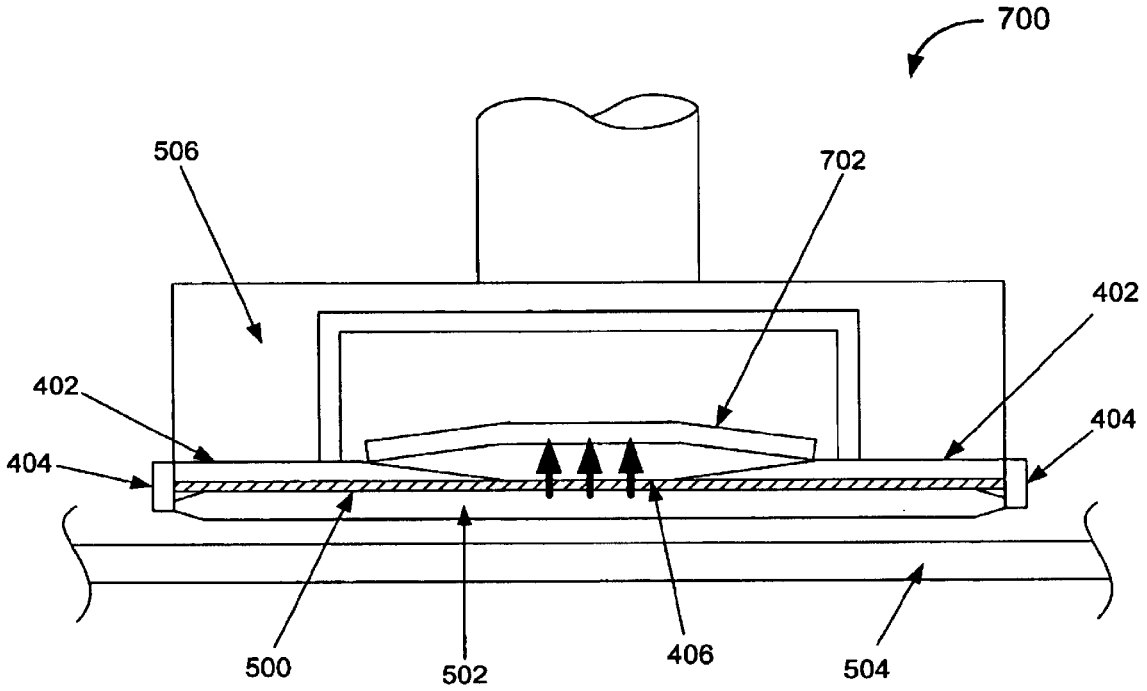
FIG. 8 is a side view of the partial-membrane carrier head, utilizing a membrane, during wafer transportation, in accordance with an embodiment of the present invention.

FIG. 8 is a side view of the partial-membrane carrier head 700 during wafer transportation, in accordance with an embodiment of the present invention. As above, the carrier head 700 includes a stainless steel plate 402 surrounded by a retaining ring 404, which holds a wafer 502 in position during polishing. Also, a carrier film 500 is positioned on the wafer side of the stainless steel plate 402, between the stainless steel plate 402 and the backside of the wafer 502.

The centrally located vacuum hole 406 allows the carrier head 700 to pick up and drop off the wafer 502. As mentioned previously, the wafer 502 often experiences "stiction" with the polishing belt 504. That is, the combination of the polyurethane of the polishing belt surface and the slurry often causes the wafer 502 to adhere to the surface of the polishing belt 504. To break this adhesion, the carrier head 700 applies a vacuum to the back of the wafer via the centrally located vacuum hole 406, which allows the carrier head 700 to lift the wafer 502 from the surface of the polishing belt 504.

Specifically, when lifting the wafer 502, a vacuum is generated within the vacuum chamber 506. The vacuum within the vacuum chamber 506 pulls the membrane 702 away from the carrier film 500 and the backside of the wafer 502. As such, the vacuum of the vacuum chamber 506 is allowed to transfer to the carrier film 500. Because of the carrier film 500 is porous, the vacuum transfers through the vacuum hole 406 and the carrier film 500 to the backside of the wafer 502. In this manner, the adhesion of the wafer 502 to the carrier head 700 resulting from the vacuum overcomes the stiction between the wafer 502 and the polishing belt 504, thus allowing the carrier head 700 to lift the wafer 502.

As discussed above with reference to FIG. 6, the vacuum generally can be allowed to dissipate once the wafer 502 is removed from the polishing surface 504 because the wafer 502 typically adheres to the wet carrier film 500 during transportation. Hence, the vacuum chamber 506 can be implemented such that it produces only a dynamic vacuum, which dissipates after a particular time period.

After transporting the wafer 502 to its destination, the carrier head 400 applies pressure to the membrane 702 such that the membrane 702 protrudes through the vacuum hole 406. The protruding membrane 702 creates a bulge in the carrier film 500, which releases the wafer 502 from the carrier head 400. As mentioned above, embodiments of the present invention can also release the wafer 502 from the carrier head 400 by applying a positive airflow through the vacuum hole 406.

As with the bladder based embodiment described above with reference to FIGS. 5 and 6, low removal rate vacuum hole regions are not generated on the wafer surface in those areas because the plurality of vacuum holes is removed. Further, the membrane 702 provides pressure in the region of the centrally located vacuum hole 406 during polishing. Thus, a low removal rate vacuum hole region is prevented from occurring in the wafer surface in the region of the centrally located vacuum hole 406.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for polishing a wafer during a chemical mechanical polishing (CMP) process, comprising the operations of:

positioning a wafer on a carrier head comprising a metal plate having an opening formed in a central location, and a bladder being larger than the opening and positioned above the opening in the metal plate and on a side of the metal plate opposite a side on which the wafer is positioned;

applying the wafer to a polishing surface using the carrier head, the wafer being applied with a particular polishing pressure;

inflating the bladder to a pressure that is substantially equivalent to the polishing pressure; and polishing a surface of the wafer.

2. A method as recited in claim 1, further comprising the operation of positioning a carrier film between the metal plate and a backside of the wafer.

3. A method as recited in claim 2, wherein the metal plate and the bladder provide a substantially uniform force to the carrier film.

4. A method as recited in claim 1, further comprising the operation of applying a vacuum to the opening in the metal plate to adhere the wafer to the carrier head to facilitate transporting the wafer.

5. A method as recited in claim 4, further comprising the operation of deflating the bladder when the vacuum is applied to the opening in the metal plate.

6. A method as recited in claim 5, further comprising the operation of inflating the bladder to release the wafer from the carrier head.

7. A method as recited in claim 6, wherein the bladder is inflated such that the bladder protrudes through the opening in the metal plate to release the wafer from the carrier head.

8. A carrier head for use in a chemical mechanical polishing (CMP) process, comprising:

a metal plate having an opening formed in a central location, the metal plate having a wafer side and a non-wafer side, the wafer side facing a backside of a wafer during a CMP operation; and a bladder being larger than the opening in the metal plate, the bladder being positioned above the non-wafer side of the metal plate and located above the opening in the metal plate, wherein an inflating pressure is applied to the bladder substantially equivalent to a polishing pressure utilized during the CMP operation.

9. A carrier head as recited in claim 8, further comprising a carrier film positioned on the wafer side of the metal plate, wherein the carrier film is disposed between the metal plate and the backside of the wafer during a CMP operation.

10. A carrier head as recited in claim 9, wherein the metal plate and the bladder provide a substantially uniform force to the carrier film.

11. A carrier head as recited in claim 8, wherein a vacuum is applied to the opening in the metal plate to adhere the wafer to the carrier head to facilitate transporting the wafer.

12. A carrier head as recited in claim 11, wherein the bladder is deflated when the vacuum is applied to the opening in the metal plate.

13. A carrier head as recited in claim 12, wherein the bladder is inflated to release the wafer from the carrier head.

14. A carrier head as recited in claim 13, wherein the bladder is inflated such that the bladder protrudes through the opening in the metal plate to release the wafer from the carrier head.

15. A carrier head for use in a chemical mechanical polishing (CMP) process, comprising:

a metal plate having an opening formed in a central location, the metal plate having a wafer side and a non-wafer side, the wafer side facing a backside of a wafer during a CMP operation; and a membrane being larger than the opening of the metal plate, the membrane being positioned above the non-wafer side of the metal plate and located above the opening in the metal plate, wherein a pressure is applied to the membrane substantially equivalent to a polishing pressure utilized during the CMP operation.

16. A carrier head as recited in claim 15, further comprising a carrier film positioned on the wafer side of the metal plate, wherein the carrier film is disposed between the metal plate and the backside of the wafer during a CMP operation.

17. A carrier head as recited in claim 16, wherein the metal plate and the membrane provide a substantially uniform force to the carrier film.

18. A carrier head as recited in claim 15, wherein a vacuum is applied to the opening in the metal plate to adhere the wafer to the carrier head to facilitate transporting the wafer.

19. A carrier head as recited in claim 18, wherein a releasing pressure is applied to the membrane to release the wafer from the carrier head.

20. A carrier head as recited in claim 19, wherein the releasing pressure causes the membrane to protrude through the opening in the metal plate to release the wafer from the carrier head.

* * * * *